US005192401A

United States Patent [19]

DuBois et al.

[11] Patent Number: 5,192,401

[45] Date of Patent: Mar. 9, 1993

[54] DIAPHRAGM FOR USE IN CHLOR-ALKALI CELLS

[75] Inventors: Donald W. DuBois, Irwin; Colonel R. Dilmore, Jeannette, both of Pa.

[73] Assignee: PPG Industries, Inc., Pittsburgh, Pa.

[21] Appl. No.: 637,110

[22] Filed: Jan. 3, 1991

Related U.S. Application Data

[63] Continuation-in-part of Ser. No. 494,911, Mar. 9, 1990, abandoned, which is a continuation of Ser. No. 284,015, Dec. 14, 1988, abandoned.

[51] Int. Cl.[5] ..... C25B 1/16; C25B 13/04

[52] U.S. Cl. ..... 204/98; 204/128; 204/295; 204/296; 427/376.1; 427/376.2

[58] Field of Search ..... 204/295, 296, 98, 128, 204/129; 427/77, 58, 376.1, 376.2

[56] References Cited

U.S. PATENT DOCUMENTS

| | | | |
|---|---|---|---|
| 4,170,537 | 10/1979 | Simmons | 204/295 |
| 4,170,538 | 10/1979 | Simmons | 204/295 |
| 4,253,935 | 3/1981 | Simmons | 204/296 |
| 4,680,101 | 7/1987 | Darlington et al. | 204/295 |
| 4,853,101 | 8/1989 | Hruska et al. | 204/295 |

*Primary Examiner*—John Niebling
*Assistant Examiner*—Kathryn Gorgos
*Attorney, Agent, or Firm*—Edward J. Whitfield; Irwin M. Stein

[57] ABSTRACT

A liquid permeable diaphragm for use in an electrolytic chlor-alkali cell, the diaphragm being made of fibrous material and having particulate zirconia deposited in the interstices of the fibrous matrix, prior to installing the diaphragm in the cell. Also described is a zirconia impregnated fibrous diaphragm having a zirconia topcoating applied to the anode face thereof.

17 Claims, No Drawings

DIAPHRAGM FOR USE IN CHLOR-ALKALI CELLS

CROSS-REFERENCE TO RELATED APPLICATIONS

This application is a continuation-in-part of copending application Ser. No. 07/494,911 filed Mar. 9, 1990 now abandoned which is a continuation of application Ser. No. 07/284,015 filed Dec. 14, 1988, now abandoned.

BACKGROUND OF THE INVENTION

Chlorine, hydrogen and aqueous alkali metal hydroxide may be produced electrolytically in a diaphragm cell wherein alkali metal chloride brine, e.g., sodium or potassium, chloride brine, is fed to the anolyte compartment of the cell, chlorine being evolved at the anode, the electrolyte percolating through a liquid permeable diaphragm into the catholyte compartment wherein hydroxyl ions and hydrogen are evolved at the cathode.

The diaphragm which separates the anolyte compartment from the catholyte compartment must be sufficiently porous to permit hydrodynamic flow of brine but must also inhibit back migration of hydroxyl ions from the catholyte compartment into the anolyte compartment as well as prevent mixing of evolved hydrogen and chlorine gases which could pose an explosive hazard.

Asbestos or asbestos in combination with various polymeric resins, particularly fluorocarbon resins (so-called modified asbestos) have long been used as diaphragm materials. Recently, due primarily to the health hazards posed by asbestos, numerous non-asbestos or synthetic diaphragms have been developed and are extensively described in the art. Such synthetic diaphragms are typically made of fibrous polymeric material resistant to the corrosive atmosphere of the cell and are typically made using perfluorinated polymeric material, e.g., polytetrafluoroethylene (PTFE). Such diaphragms may also contain various other modifiers and additives, e.g., inorganic fillers, pore formers, wetting agents, ion exchange resins or the like. Some of said synthetic diaphragms are described, for example, in U.S. Pat. Nos. 4,036,729; 4,126,536; 4,170,537; 4,210,515; 4,606,805; 4,680,101; 4,720,334 and 4,853,101.

Regardless of the nature of the diaphragm, i.e., be it asbestos, modified asbestos or synthetic, variations are often observed in cell operating characteristics, e.g., variations in diaphragm permeability and porosity, cell voltage, current efficiency and hydrogen content in the evolved chlorine.

OBJECT OF THE INVENTION

It is the principal object of the invention to provide an improved liquid permeable diaphragm for use in electrolytic chlor-alkali cells which diaphragm improves cell operating characteristics by enabling desirably low cell voltage and desirably high current efficiency while minimizing contamination of evolved chlorine by hydrogen.

THE INVENTION

The foregoing object and others are accomplished in accordance with a first embodiment of this invention by impregnating a preformed liquid permeable chlor-alkali diaphragm, composed principally of fibrous material resistant to the cell environment, with at least one water soluble, hydrolyzable zirconium containing compound, hydrolyzing the zirconium to hydrous oxide, and drying the zirconium hydrous oxide impregnated diaphragm to thereby deposit particulate zirconia in the interstices of the fibrous diaphragm matrix to strengthen the diaphragm and improve its dimensional stability.

The preformed diaphragm may be made of any fibrous material or combination of materials known to the chlor-alkali art and can be prepared by any technique know to the chlor-alkali art. Such diaphragms are typically made substantially of fibrous material, such as traditionally used asbestos or more recently of plastic fibers resistant to the cell environment, such as polytetrafluoroethylene (PTFE). Such diaphragms can be prepared by vacuum depositing the diaphragm material from a liquid slurry onto a permeable substrate, e.g., a foraminous cathode. The foraminous cathode is electroconductive and may be a perforated sheet, a perforate plate, metal mesh, expanded metal mesh, woven screen, metal rods or the like, having openings typically in the range of from about 0.05 to about 0.125 inch in diameter. The cathode is typically fabricated of iron, iron alloy or some other metal resistant to the cell environment, e.g., nickel. The diaphragm material is typically deposited on the cathode substrate in an amount ranging from about 0.1 to about 1.0 pound per square foot of substrate; the deposited diaphragm typically having a thickness of from about 0.1 to about 0.25 inch.

Following deposition of the diaphragm material on the cathode substrate, the resultant cathode assembly, i.e., the preformed diaphragm, is subjected to further processing in accordance with this invention. The preformed diaphragm prior to processing in accordance with this invention may first be dried by heating in an oven at a temperature below the sintering or melting point of any fibrous organic material of which the preformed diaphragm is made, e.g., PTFE. Drying is typically effected at a temperature in the range of from about 50° C. to about 225° C., preferably at from about 90° C., to about 150° C. for up to about 4 hours. Of course, the diaphragm need not be dried but can be processed while still wet or damp in accordance with this invention.

The cathode assembly, i.e., the preformed diaphragm is then impregnated with an aqueous medium containing water soluble, hydrolyzable zirconium compound which compound is then hydrolyzed to zirconium hydrous oxide. The zirconium hydrous oxide impregnated diaphragm is then dried, preferably to a moisture content of less than about 10 weight percent to thereby deposit particulate zirconia in the interstices of the diaphragm matrix. In a preferred embodiment, the preformed diaphragm is immersed in an aqueous solution of, e.g., zirconyl chloride, for a time sufficient to saturate and penetrate the interstices of the diaphragm matrix. Alternatively, the solution can be applied to the diaphragm by brushing or spraying. The impregnated diaphragm is then contacted preferably by immersion in aqueous sodium hydroxide solution for a time sufficient to precipitate hydrous oxide of zirconium within the interstices of the diaphragm matrix. Typically, immersion in and contact with an about 10 percent aqueous sodium hydroxide solution for about 2 hours will suffice to substantially completely deposit all of the zirconium in its hydrous oxide form. It is of course to be understood that conversion, i.e., hydrolysis, of the zirconium halide to the hydrous oxide may be effected by contacting the impregnated diaphragm with any liquid or gaseous base, e.g., potassium hydroxide solution, cell liquor, ammonium hydroxide solution or ammonia gas. The zirconium hydroxide impregnated diaphragm is then dried to a moisture content of less than about 10 weight percent, drying of the diaphragm being preferably effected by heating. If the diaphragm is one composed largely of plastic fibers, e.g., polytetrafluoroethylene fibers, drying is effected by heating at a temperature below the melting or sintering point of the fibers. For most purposes, drying of the diaphragm is effected at a temperature in the range of from about 50° C. to about 225° C., preferably from about 90° C. to about 150° C. for up to about 20 hours to strengthen the diaphragm and improve its dimensional stability. The dried diaphragm has substantially unhydrated zirconia particles substantially uniformly distributed in the interstices of the matrix thereof. The zirconia content of the dried diaphragm is preferably at least about 2 weight percent and may range up to about 25 weight percent, which approximately corresponds to a zirconia loading of from about 0.01 to about 0.1 pound of zirconia per square foot of cathode surface area.

Although zirconium halide, e.g., zirconyl chloride, is the preferred source of zirconia, any water soluble, hydrolyzable zirconium compound may be used alone or in combination with zirconium halide. Examples of other zirconium compounds include zirconium ammonium carbonate and zirconyl sulfate. It is to be further understood that other inorganic, water soluble, hydrolyzable metal salts may be used along with said zirconium compounds to impregnate the diaphragm. Such other hydrolyzable metal salts include iron and magnesium salts, e.g., iron and magnesium chlorides.

Although the dried, zirconia impregnated diaphragm may be used as such in an electrolytic chlor-alkali cell, in another embodiment of the invention, the diaphragm may be further treated prior to installation in the cell, which treatment has been found to additionally enhance diaphragm strength and dimensional stability.

In this second embodiment of the invention, the dried, zirconia impregnated diaphragm is provided with at least one topcoating comprising inorganic, particulate, refractory material on the anode face thereof. The topcoat is preferably applied to the zirconia impregnated diaphragm by vacuum depositing the topcoat material from an aqueous slurry of same in a manner analogous to the previously described mode of preparing the diaphragm prior to treatment in accordance with the first embodiment of this invention. Alternatively, the aqueous slurry of topcoat material may be applied to the zirconia impregnated diaphragm by dipping, brushing or spraying. The aqueous slurry of topcoat material typically contains from about 2 to about 5 weight percent solids and, in addition to zirconium containing compound, may also contain typically used viscosity modifiers, surfactants or the like.

Inorganic, particulate, refractory material used to topcoat the zirconia impregnated diaphragm can be any hard, oxide, boride, carbide, silicate, or nitride of the so-called valve metals, e.g., vanadium, chromium, zirconium, niobium, molybdenum, hafnium, tantalum, titanium and tungsten, or mixtures thereof. Other materials, e.g., silicon carbide, are also useful. Inorganic particulate, refractory material preferred for use as topcoating materials include finely divided or powdered zirconium oxide or zirconium silicate or mixtures thereof. While not wishing to be bound by any particular particle size, it has been found that materials with a mass-based spherical diameter of from about 0.3 to about 10 microns, preferably from about 1.0 to about 5.0 microns, are especially useful. It is to be understood that, although the median particle size will be found in this range, individual size fractions with diameters up to about 40 microns and down to about 0.3 micron or less may be represented in the distribution of particle size. Sufficient topcoat material is deposited on the anode face of the diaphragm so as to provide, on a dry basis, from about 0.01 to about 0.5, preferably from about 0.05 to about 0.2, pound per square foot of inorganic, particulate refractory material, e.g., zirconium oxide or zirconium silicate, per square foot of cathode area. In addition, the topcoating slurry may also contain water soluble zirconium compounds, e.g., the aforementioned zirconyl halides, zirconium ammonium carbonate or zirconium phosphate. After deposition of the topcoat the diaphragm is usually not heat dried by heat treatment but is typically air dried for an hour or two and installed in the cell while still wet or damp.

The invention is further illustrated, but is not intended to be limited, by the following Examples.

EXAMPLE 1

A non-asbestos, fibrous polytetrafluoroethylene (PTFE) diaphragm having a dry weight of about 0.34 pound per square foot of cathode area was prepared by vacuum deposition of the diaphragm materials onto a steel mesh cathode from an aqueous slurry of approximately the following weight percent composition:

0.5% of Cellosize® QP 52 OOOH hydroxyethyl cellulose (product of Union Carbide Corp.);

0.08% of 1 Normal sodium hydroxide solution;

1.0% of Avanel® N-925 non-ionic surfactant (product of PPG Industries, Inc.);

0.2% of UCON® LO-500 antifoaming agent (product of Union Carbide Corp.);

0.02% of Ucarcide® 250 50% aqueous glutaraldehyde antimicrobial solution (product of Union Carbide Corp.);

0.38% of ¼" chopped 6.67 denier Teflon® polytetrafluoroethylene floc (product of E. I. DuPont de Nemours & Co.);

0.18% of 6.5. micron X ⅛" chopped DE fiberglass with 610 35 binder (product of PPG Industries, Inc.);

0.1% of Short Stuff® GA 844 polyethylene fibers (product of Minifibers Corp.);

1.1% of polytetrafluoroethylene microfibers having a length of 0.2–0.5 mm and a diameter of 10–15 microns, prepared as described in U.S. Pat. No. 5,030,403 the teachings of which are incorporated by reference herein, vis a vis, preparation of said microfibers;

0.016% of Nafion® 601 ion exchange material having sulfonic acid functional groups (product of DuPont); and the balance, water.

A portion of the above slurry was used to deposit a diaphragm on a cathode constructed of 6 mesh, mild steel screen such as used in commercial size chlorine cells. The diaphragm was deposited by drawing said portion of the slurry under vacuum through said cathode screen. The vacuum was gradually increased to 18" Hg over a 15 minute period and held at 18" Hg vacuum until about 900 ml of slurry had been drawn through the cathode screen. The diaphragm was then dried in an oven at 118° C. for 1 hour. The dry diaphragm contained 0.34 lb. of diaphragm material per square foot of cathode area.

The dry diaphragm was immersed in a solution of 25.6 wt-% zirconyl chloride ($ZrOCl_2.8H_2O$) for 20 minutes. It absorbed about 22.5 grams of solution. The wet diaphragm was then immersed in a solution of 25 wt % NaOH overnight to precipitate zirconium hydroxide. The diaphragm was then placed in an oven at 117° C. and dried for 100 minutes. The dry diaphragm was installed in a laboratory cell and operated. Since the diaphragm was quite permeable, anolyte doping was required. The first day 0.5 gram attapulgite clay was added to the anolyte. The second day 1 gram clay and 0.04 gram magnesium as magnesium chloride were added to the anolyte. The third day 0.9 gram clay and 0.03 gram Mg (as $MgCl_2$) were added after adjusting the anolyte to about pH 1 with hydrochloric acid. On the fifth day, 0.3 gram attapulgite clay was added to the anolyte. After 7 days, the cell was operating at 97% efficiency and 3.20 volts with a 15" differential brine level. No hydrogen was detected in the chlorine gas.

EXAMPLE 2

A diaphragm containing abut 0.35 pound of diaphragm material per square foot of cathode area was deposited in accordance with the procedure described in Example 1. The oven dried diaphragm was immersed in a solution of 16.5 wt % zirconyl chloride for about 20 minutes followed by about 2 hours immersion in 10 wt % sodium hydroxide solution. The diaphragm was baked in an oven at 120° C. for about 1 hour. The dried diaphragm was then topcoated by drawing an aqueous suspension containing about 3 wt % of Zircopax® A zirconium silicate powder through the diaphragm at a vacuum of about 15" Hg. About 420 ml of aqueous zirconium silicate slurry was drawn through the diaphragm. The topcoated diaphragm was installed, while still wet, into a laboratory chlor-alkali cell and operated at 144 amperes/sq. ft. and 194° F. The diaphragm was less permeable than that prepared in Example 1, and the anolyte required no doping for the first day of operation. On the second and third days of operation, 0.5 grams of attapulgite clay and 0.05 gram of Mg (as $MgCl_2$) were added to the anolyte, the anolyte pH having first been adjusted to about 1.0 by addition of hydrochloric acid. On the fourth day of operation, another 0.05 gram of Mg (as $MgCl_2$) was added to the anolyte, the anolyte being at pH 1.0. After 7 days, the cell was operating at 3.17 volts, a 9.8" hydrostatic head, a current efficiency of 95.5 and was producing 113 grams per liter of sodium hydroxide. Evolved chlorine gas contained 0.15% hydrogen and 1.36% oxygen.

Although the invention has been described and illustrated in some detail by the foregoing, many variations therein will be apparent to those skilled in the art without departing from the spirit and scope of the invention as defined by the appended claims. For example, even through the invention was made (and is so illustrated) for improving the performance characteristics of chlor-alkali diaphragms composed principally of thermoplastic fibrous material, e.g. polytetrafluoroethylene fibers, of the type described, e.g. in U.S. Pat. No. 4,720,334, the invention is believed applicable to use with any type of fibrous chlor-alkali diaphragm, e.g., asbestos or polymer modified asbestos diaphragms.

We claim:

1. A method of preparing a liquid-permeable diaphragm for use in an electrolytic chlor-alkali cell having an anode in an anolyte compartment, a cathode in a catholyte compartment and a diaphragm that separates said anolyte and catholyte compartments, which comprises the steps of:

(a) impregnating a pre-formed, uncoated non-asbestos fibrous diaphragm comprised of material resistant to a chlor-alkali cell environment with an aqueous medium comprising water-soluble, hydrolyzable inorganic zirconium-containing compound, thereby providing said zirconium-containing compound within the diaphragm, (b) hydrolyzing the impregnated zirconium-containing compound, thereby to form hydrous oxide of zirconium, (c) drying the zirconium hydrous oxide-containing diaphragm to a moisture content of less than about 10 weight percent, thereby to deposit particulate substantially unhydrated zirconia within the fibrous diaphragm, and (d) depositing a topcoating of inorganic, particulate refractory material on the anode face of the particulate zirconia-containing diaphragm of step (c), said particulate refractory material being selected from the group consisting of silicon carbide, the oxides, borides, carbides, silicates or nitrides of valve materials selected from the group consisting of vanadium, chromium, zirconium, niobium, molybdenum, hafnium, tantalum, titanium and tungsten, and mixtures of such particulate refractory materials.

2. The method of claim 1 wherein the material resistant to the chlor-alkali cell environment is polytetrafluoroethylene.

3. The method of claim 2 wherein the zirconium-containing compound is selected from the group consisting of zirconyl halide, zirconium ammonium carbonate, zirconyl sulfate and mixtures of such zirconium compounds.

4. The method of claim 3 wherein the zirconium-containing compound is zirconyl chloride.

5. The method of claim 4 wherein the particulate refractory material is selected from the group consisting of finely-divided zirconium oxide, zirconium silicate and mixtures thereof.

6. The method of claim 1 wherein the zirconium-containing compound is hydrolyzed by contact with an aqueous solution of sodium hydroxide.

7. The method of claim 1 wherein the particulate refractory material is selected from the group consisting of finely-divided zirconium oxide, zirconium silicate and mixtures thereof.

8. A method of preparing a liquid-permeable diaphragm for use with a foraminous cathode in an electrolytic chlor-alkali cell having an anode in an anolyte compartment, a cathode in a catholyte compartment and a diaphragm that separates said anolyte and catholyte compartments, which comprises the steps of:

(a) impregnating a pre-formed uncoated non-asbestos fibrous diaphragm comprised of polytetrafluoroethylene with an aqueous medium consisting essentially of zirconyl chloride, thereby providing zirconyl chloride within the diaphragm, (b) hydrolyzing the impregnated zirconyl chloride by contacting the zirconyl chloride with a liquid or gaseous base material, thereby to form hydrous oxide of zirconium, (c) drying the zirconium hydrous oxide-containing diaphragm to a moisture content of less than about 10 weight percent, thereby to deposit particulate substantially unhydrated zirconia within the fibrous diaphragm, and (d) depositing a topcoating of inorganic, particulate refractory material selected from the group consisting of finely-divided zirconium oxide, zirconium silicate titanium oxide and mixtures thereof on the anode face of the particulate zirconia-containing diaphragm.

9. The method of claim 8 wherein the base material is an aqueous solution of sodium hydroxide.

10. The method of claim 9 wherein the diaphragm is dried at temperatures of from about 90° C. to about 150° C. for up to about 20 hours.

11. The method of claim 9 wherein the amount of particulate zirconia in the fibrous diaphragm is from about 0.01 to about 0.1 pound per square foot of cathode surface area.

12. The method of claim 11 wherein the amount of inorganic, particulate refractory topcoat material is from about 0.01 to about 0.5 pound per square foot of cathode surface area.

13. A liquid-permeable diaphragm for use with a foraminous cathode in an electrolytic chlor-alkali cell, wherein said diaphragm consists essentially of non-asbestos fibrous material resistant to a chlor-alkali cell environment having substantially unhydrated particulate zirconia within the fibrous material, and a topcoating of inorganic, particulate refractory material selected from the group consisting of finely-divided titanium oxide, zirconium oxide, zirconium silicate and mixtures thereof, the amount of particulate zirconia within the fibrous material being from about 0.01 to about 0.1 pound per square foot of cathode surface area and the amount of inorganic, particulate refractory material topcoat being from about 0.01 to about 0.5 pound per square foot of cathode surface area.

14. The liquid-permeable diaphragm of claim 13 wherein the fibrous material resistant to the chlor-alkali cell environment is perfluorinated polymeric material.

15. The liquid-permeable diaphragm of claim 14 wherein the perfluorinated polymeric material is polytetrafluoroethylene.

16. In a process of electrolyzing alkali metal chloride in an electrolytic cell having an anolyte compartment, a catholyte compartment and a diaphragm that separates said anolyte and catholyte compartments, wherein the improvement comprises using as the diaphragm a diaphragm as defined in claims 1, 4, 5, 7 or 11.

17. The process of claim 16 wherein the alkali metal chloride is sodium chloride.

* * * * *